United States Patent [19]

Dasher

[11] 3,983,910

[45] Oct. 5, 1976

[54] BOX SPRING GRID AND METHOD OF MANUFACTURE

[75] Inventor: Wayne G. Dasher, Danbury, Conn.

[73] Assignee: The Gilbert & Bennett Manufacturing Co., Georgetown, Conn.

[22] Filed: Aug. 11, 1975

[21] Appl. No.: 603,610

[52] U.S. Cl. ..... 140/3 CA; 140/107; 5/273; 5/267

[51] Int. Cl.[2] ..... B21F 27/16

[58] Field of Search ..... 140/3 R, 3 CA, 71 R, 140/107, 105; 5/265, 266, 267, 275, 276, 277, 273, 248

[56] References Cited

UNITED STATES PATENTS

| | | | |
|---|---|---|---|
| 441,653 | 12/1890 | Foster | 5/267 |
| 487,288 | 12/1892 | Monzel | 5/273 |
| 568,101 | 9/1896 | Rouse | 5/267 |
| 3,063,472 | 11/1962 | Winters | 140/3 CA |
| 3,577,574 | 5/1971 | Ciampa et al. | 5/273 |

*Primary Examiner*—Lowell A. Larson
*Attorney, Agent, or Firm*—Alfred L. Michaelsen

[57] ABSTRACT

A box spring grid which includes coil spring engaging ears and a plurality of support wires secured to the grid and each including an ear. The ends of each support wire may be reversely bent around one end coil of a coil spring. Also disclosed is a method of manufacturing a box spring support grid wherein ears are formed in all longitudinal wires, between each pair of transverse wires, and, subsequently, selected portions of certain longitudinal wires are removed.

3 Claims, 8 Drawing Figures

BOX SPRING GRID AND METHOD OF MANUFACTURE

BACKGROUND OF THE INVENTION

Conventional box springs for supporting mattresses are comprised of a lower wooden support frame and an upper wire mesh support grid which is secured to a steel frame. Between the upper grid and the lower wood frame there are disposed a plurality of springs which are generally helical or cyclindrical coil springs. To insure that the axis of each of the springs remains vertical, each spring must be secured to both the upper grid and to the lower wood frame.

The prior art discloses a number of grid constructions which include means for securing the top or bottom coil of a spring to the grid. For example, U.S. Pat. No. 867,952 discloses a construction wherein the longitudinal grid wires are provided with ears or wings and the end coil of a spring is stretched around the ears. To insure that the coils of the spring remain stationary, so called tie rods are employed and are secured to the end coil of the spring by clips. One of the disadvantages of such a construction is the necessity of supplying such clips. Thus, from the point of view of the box spring manufacturer, the clips are another item of inventory and are another item which the spring assembler must have available and must mount on the product. As a result, both manufacturing and material costs are increased.

U.S. Pat. No. 3,199,122 discloses a construction which employs so called links to hold the springs on a grid. While such a construction probably functions adequately to hold the springs in place, several disadvantages attend the use and assembly of this construction. For example, when the support grid and the springs are assembled, each of the links must be essentially woven between the end coil of a spring and the wire mesh which comprises the support grid. Thus, assembly time and costs are increased and it is necessary for the assembler to have available not only a quantity of coil springs and a pair of grids but, additionally, a quantity of links. Further, after the assembly is completed and the mattress is used, the nature of the construction is such as to permit relative movement between the links and the end coils of the springs whereby noise may be generated.

Another prior art construction is disclosed in U.S. Pat. No. 3,662,411 wherein a wire mesh support grid is provided together with coil springs wherein the end coils of each spring are deformed so as to provide ears which may engage the support grid. Although this construction does not require the use of separately supplied links, it will be evident that conventional coil springs cannot be used, rather, each of the coil springs is modified so as to provide a plurality of ears in each end coil. As a result, the cost of the coil springs is increased and the commercial availability of acceptable springs may be reduced.

The present invention resides in a support grid construction which does not require the use of specially constructed springs. Additionally, a support grid embodying this invention will not require the use of separately mounted or woven connecting links. Thus, in accordance with this invention, a support grid may be supplied to a spring manufacturer and conventional coil springs may be mounted thereon without significantly extending the assembly time or requiring the use of additional parts. Moreover, the resulting box spring has been found to be particularly quiet, durable, stronger and provides a flatter surface with smaller openings for a mat to lie on when assembled.

SUMMARY OF THE INVENTION

A box spring support grid comprised of a plurality of longitudinally and transversely, spaced apart wires, all of said wires being connected at respective intersections. A plurality of coil spring engaging ears are formed in each longitudinally disposed wire, between adjacent transverse wires. Certain longitudinally disposed wires are support wires and portions thereof are removed so as to define end extensions. Conventional coil springs may be mounted on the resulting support grid by engaging one end coil of each spring around a selected pair of coil spring engaging ears and reversely bending the ends of the adjacent support wires about opposite portions of the end coil so that the coil is held at four points spaced 90° apart.

The box spring support grid described above may be formed by supplying a wire mesh grid comprised of longitudinal grid wires and longitudinal support wires and transverse grid wires and forming an ear in each longitudinal wire. Before or after the ear forming operation, selected portions of the longitudinal support wires are removed. Preferably, after the ear forming operation, the ears formed in the longitudinal grid wires are transversely deformed.

DESCRIPTION OF PREFERRED EMBODIMENTS

Figure 1:
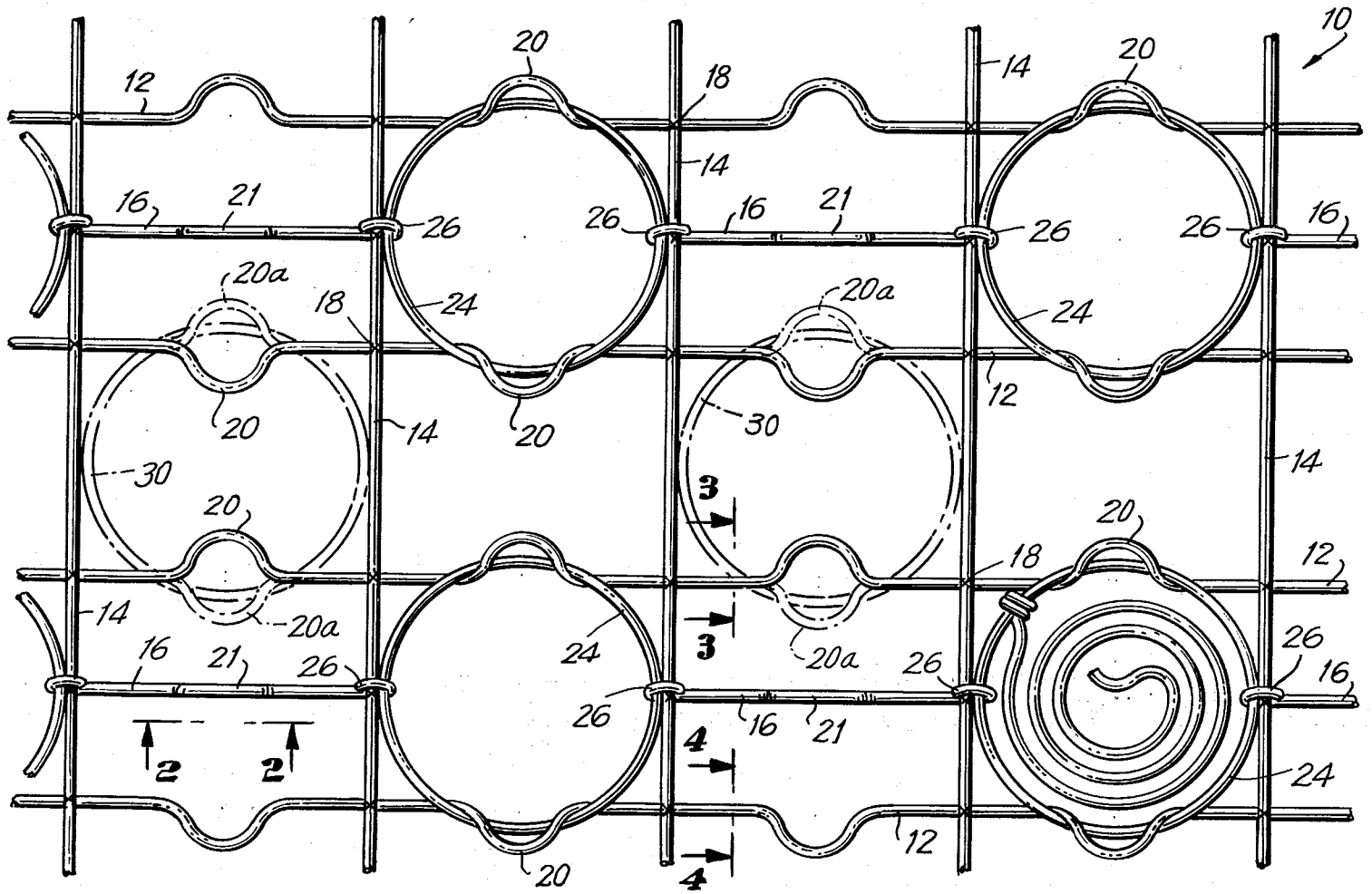
FIG. 1 is a plan view of a box spring support grid embodying the instant invention and showing a illustrative arrangement of coil springs.

Referring to FIG. 1, wire mesh grid 10 is comprised of a plurality of spaced apart, orthogonally disposed wires. More particularly, the wire mesh grid 10 is comprised of a plurality of longitudinally disposed warp wires 12 and a plurality of transversely disposed fill wires 14. Additionally, the grid 10 of FIG. 1 includes a plurality of support wires 16 which are disposed parallel to the warp wires 12. All the longitudinally disposed wires of the grid are secured, preferably by welding, to the orthogonally disposed fill wires 14 at intersections, for example the intersections 18.

Figure 2:
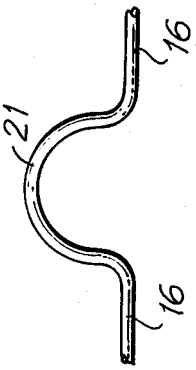

Between each pair of fill wires 14, an ear 20 is formed in each longitudinally disposed wire. Thus, it will be seen that a plurality of ears 20 are formed in each of the longitudinally disposed warp wires 12, a different one of said ears being disposed between each pair of adjacent fill wires 14. Similarly, each individual support wire 16 includes an ear 21 formed therein between the fill wires 14 adjacent to it. FIG. 2 is a fragmentary side view of a support wire 16 showing an ear 21 formed therein.

Also shown in FIG. 1 is the end coil 24 of a plurality of coil springs. As may be seen, each end coil 24 has been expanded so as to have been snapped over opposing pairs of ears 20 whereby opposite sides of each end coil are engaged by a respective ear. Additionally, intermediate each ear one end of a support wire 16 has been reversely bent, as at 26, so as to engage and grip an end coil 24. In order to insure an adequate engagement between the reversely bent end portions of the support wires and the end coils of the springs, each of the rectangles or openings formed by a pair of fill wires and a pair of warp wires is dimensioned such that the distance between any pair of fill wires is not less than the inner diameter of the end coil of the spring to be attached thereto. In this manner, it is insured that each of the reversely bent end portions of a support wire 26 positively contact and engage the end coil of a spring. Also, it is preferable that the transverse dimension of each opening or rectangle be less than the inner diameter of the end coil which will be secured therein. However, this latter limitation regarding the transverse dimension of each rectangle or opening contemplates that a spring coil will be expanded, and the grid wires contracted, when a spring is mounted on the grid. Thus, with this preferred construction, the end coil of each spring may be slightly elongated when it is mounted on the support grid 10.

Close inspection of the construction shown in FIG. 1 will reveal that all the springs are transversely aligned. An alternate construction comprehended by this invention would include staggered patterns of the spring coils, for example a pattern wherein spring coils are provided as shown in phantom at 30. Comparing such an alternating spring pattern with the transversely aligned spring pattern discussed above, it will be seen that one manifestation of such an alternating pattern is the requirement to construct the grid 10 so as to provide alternatingly and oppositely extending ears 20. For example, it will be noted that the ears **20*a* shown in phantom extend in a direction opposite to the ears 20**. Thus, it will be seen that by an inspection of the support grid, one may discern the spring pattern which is to be employed or which is employable.

Figure 4:
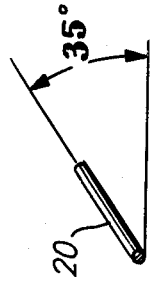
FIGS. 2–4 are fragmentary views of portions of the assembly shown in FIG. 1 taken on lines 2—2, 3—3 and 4—4 of FIG. 1.
Figure 3:
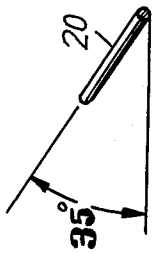

Considering further the configuration of the ears provided in the longitudinally disposed warp wires of the grid 10 shown in FIG. 1, at least two factors are noteworthy. First, as shown more clearly in FIGS. 3 and 4, the ears 20 on the warp wires 12 preferably extend outwardly and upwardly, e.g. the ears 20 on the warp wires preferably extend at an angle of approximately 35° to the plane of the grid. However, as may be seen from a consideration of FIG. 2, the ears 20 in the support wires 16 preferably extend in a plane which passes through the support wire 16 and which is perpendicular to the plane of the grid. Although the ears 20 on the support wires 16 may also extend at an acute angle with respect to the plane of the grid, in the preferred embodiment of my invention the ears in the support wires 16 extend vertically as described above.

Although not shown in FIG. 2, the edge portions of the grid 10 are securable to a metal frame by conventional means known to those skilled in the art. For example, extensions of the warp, fill and support wires may be provided and may extend through and be reversely bent around a frame member.

Figure 5:
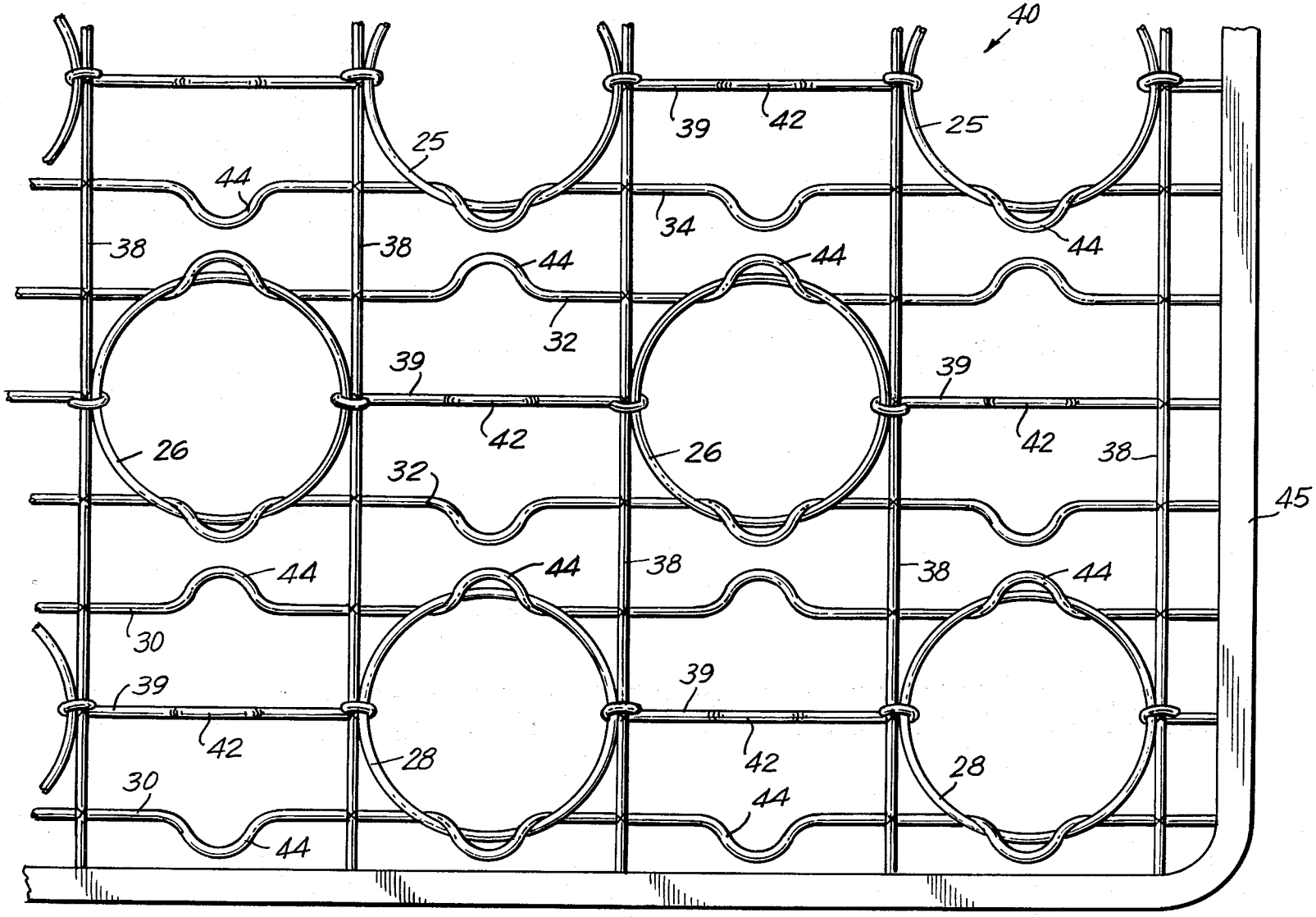
FIG. 5 is a plan view of a box spring support grid embodying another form of this invention and showing an array of spring coils.

Referring to FIG. 5 there is shown a plan view of a box spring support grid embodying another form of my invention. Similar to the embodiment of FIG. 1, the embodiment of FIG. 5 is comprised of a support grid 40 having arrays of longitudinally aligned coil springs 25, 26 and 28. The portion of the grid 40 shown in FIG. 5 is comprised of longitudinally aligned warp wires 30, 32 and 34. A plurality of fill wires 38 are provided and are orthogonally disposed with respect to the warp wires. Each fill and warp wire is secured together, for example by welding, at respective intersections. Additionally, support wires 39 are secured to respective pairs of fill wires at points approximately equally distant between adjacent warp wires. Similar to the embodiment of FIG. 1, each of the support wires 39 include an ear 42 which preferably extends upwardly in a plane vertical to the support grid 40. Also, a plurality of ears 44 are formed in each of the warp wires, one such ear being disposed between each pair of fill wires, and, preferably, the ears 44 extend upwardly in a plane disposed at an angle inclined to the plane of the support grid. A preferred angle of inclination is approximately 35°. The support grid 40 may be secured to a conventional metal frame 45 by any conventional means, for example by having the ends of all warp and fill wires extend outwardly through the frame 45 and subsequently wrapping the end of such wires around the frame 45.

A significant difference between the embodiments of FIGS. 1 and 5 resides in the fact that in the embodiment of FIG. 5 each longitudinally aligned array of springs is supported by a respective pair of longitudinally disposed warp wires. Thus, referring again to FIG. 1 it will be recalled that the ears in each warp wire had to be formed in alternatingly opposite directions when springs were to be disposed in each longitudinal row as suggested in FIG. 1 by the phantoms representation 30. Obviously, it may be desirable to have springs disposed in each longitudinal row of openings defined by the support grid. However, from a manufacturing point of view it may be undesirable to fabricate the grid so as to have alternatingly, oppositely extending ears. Thus, the embodiment of FIG. 5 accommodates this situation, i.e. with the support grid 40 of FIG. 5 coil springs may be placed diagonally adjacent to each other although all the ears in a particular warp wire are pointed in generally the same direction. As will be seen from a study of FIG. 5, this desirable result accrues from the fact that there is a separate pair of warp wires for each longitudinal array of springs. In addition to this benefit, the additional warp wires thus provided also provide a stronger support grid.

Figure 6:
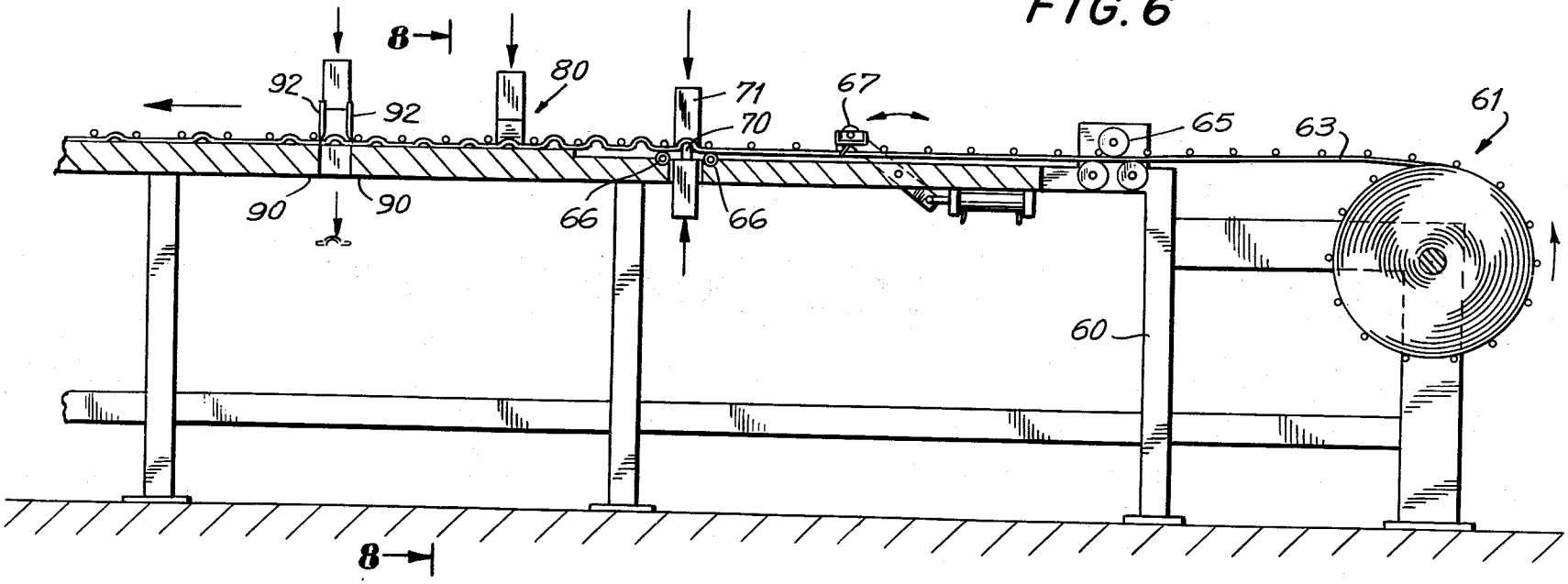
FIG. 6 is a side view of an apparatus for practicing the method of my invention.
Figure 7:
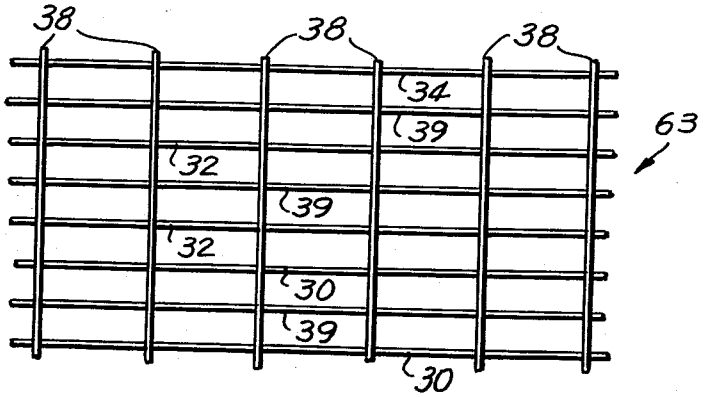
FIG. 7 is a plan view of a portion of a wire mesh grid which may be used to manufacture a product embodying my invention.

Referring to FIG. 6 there is shown a schematic representation, in side view, of an apparatus for practicing the process of my invention. Thus, there is provided a frame 60, one end of which includes an unroll stand 61. When practicing my process, a roll of wire mesh material is mounted on the unroll stand. Assuming that it is desired to produce a grid of the type shown in FIG. 5, a wire mesh 63 supplied to the apparatus 60 will have the configuration shown in FIG. 7 wherein the reference numbers used in FIG. 7 correspond to similarly numbered parts of the grid shown in FIG. 5.

As the wire mesh 63 enters the operative part of the apparatus, the mesh 63 passes between flattening rolls 65. Thereafter, the mesh 63 is engaged by an indexer 67 which intermittently moves the mesh 63 forward through the apparatus 60. Downstream of the indexer 67, the mesh 63 spans a pair of support rolls 66. When the mesh 63 is stationary, i.e. during a dwell time in the forward movement of the mesh, a pair of opposed loop forming dies 70, 71 are moved vertically toward each other and thereby form an ear in every longitudinally disposed wire. Since an ear is formed in every longitudinally disposed wire, the loop forming dies 70, 71 may have an elementary configuration, for example the male dies 70 may be comprised of a bar which extends transversely across the frame 60 and the female die 70 may be comprised of a solid member having a relieved portion which receives the loop forming bar. The dies 70, 71 may be actuated by any convenient means, for example by pneumatic or hydraulic cylinders.

Figure 8:
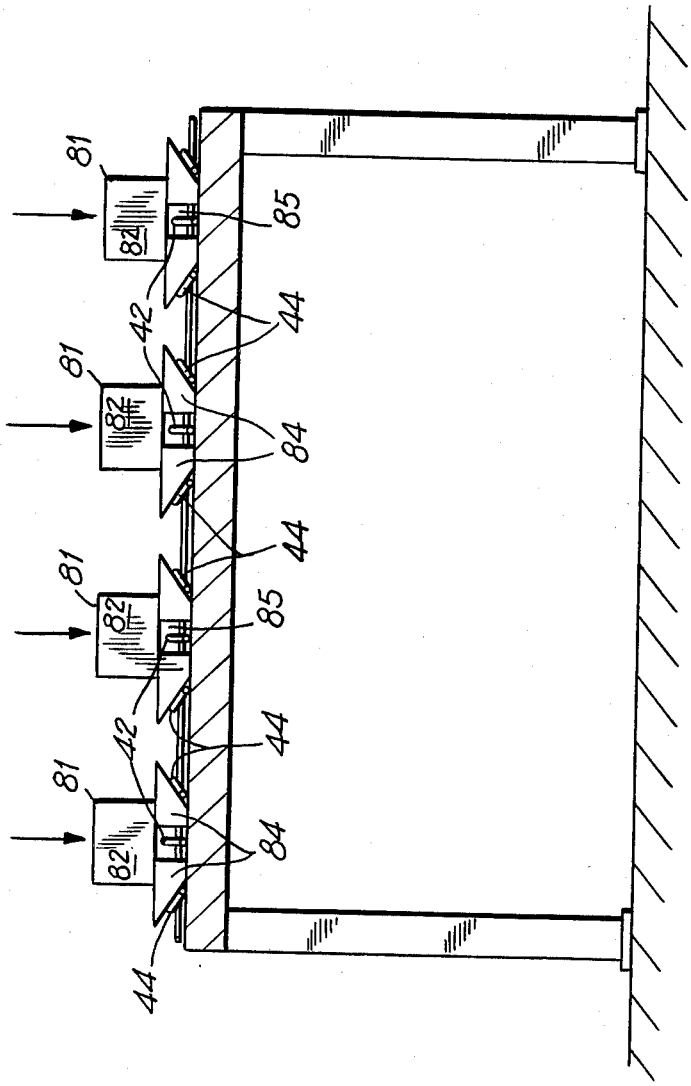
FIG. 8 is a front view of a portion of the apparatus shown in FIG. 6.

Subsequent to the loop forming operation, the mesh 63, is indexed forward so the loops just formed therein, are moved into an ear deforming section 80. As shown most clearly in FIG. 8, the ear deforming section 80 is comprised of a plurality of transversely aligned, vertically reciprocable ear deforming dies 81. Each of the ear deforming dies 81 is comprised of a mounting block 82 and a pair of ear deforming members 84 mounted thereunder. Each pair of ear deforming members 84 are spaced apart so as to provide a clearance area 85 therebetween. Additionally, the outer surface of each of the ear deforming members 84 are synclinally disposed and may be either planar or arcuate. In operation, each of the ear deforming dies 81 are actuated simultaneously, for example by the simultaneous actuation of appropriate pneumatic or hydraulic pistons and cylinders. Thus, as shown in FIG. 8, when the ear deforming dies are moved downwardly, respective pairs of ears 44 on longitudinal support wires are outwardly deformed. As a result of the space 85 provided between the ear deforming members 84, the ears 42 on each of the support wires are not deformed. After the ear deforming step has occurred, each of the ear deforming dies 81 is retracted and the grid is then indexed.

Upon indexing, a transverse portion of the grid is positioned over a pair of stationary blocks 90 which are longitudinally spaced apart a distance less then the distance between the transverse fill wires. Disposed above the blocks 90 are a plurality of pairs of cutter bars 92. Each pair of cutter bars is longitudinally aligned and is transversely positioned so as to be above a respective support wire. During a dwell in the indexing, the cutter bars 92 are driven downwardly and sever the center portion of selected support wires. Considering in more detail the operation of the cutter bars, reference is again made to FIG. 1 wherein it may be noted that support wires have been removed in a longitudinally alternating pattern. To secure this pattern of support wires, the cutter bars 92 may be rendered inoperative during alternate indexing movement of the grid. Thus, to secure the grid construction of FIG. 1, the cutter bars will be operative during one dwell period, inoperative during the following dwell period and again operative during the next dwell period. Such a periodic operation of the cutters 92 may conveniently be obtained by actuating the cutters from penumatic pistons and cylinders and controlling the actuation system from the indexer whereby the cylinders will be actuated during alternate indexing steps.

In a somewhat similar manner, the grid construction of FIG. 5 may be obtained. Referring to FIG. 5 it will be seen that support wires are provided in a longitudinally alternating array and, additionally, adjacent longitudinal arrays of support wires are displaced one from the other, i.e. adjacent longitudinal arrays of support wires are staggered. Such a construction may conveniently be obtained by providing pairs of cutter bars for each longitudinal array but alternating the actuation of the adjacent cutter bars so that adjacent cutter bars are not simultaneously actuated. For example, odd numbered cutter bars may be actuated during a first dwell time and inoperative during the second dwell time while even numbered cutter bars may be inoperative during said first dwell time and operative during said second dwell time. Once again, such staggered and alternating actuation may conveniently be achieved by appropriately interconnecting the cutter bar actuation means with the indexer, for example through the use of a geneva wheel.

With respect to the step of removing selected portions of the support wires, it should be noted that their removal step may occur at any point of the process, e.g. their step may be performed prior to the ear forming step or after the ear forming step as recited above.

Illustrative of the construction and size associated with a typical spring grid embodying my invention, the grid of FIG. 1 may employ fill and warp wires having a diameter of 0.086 inches and the distance between each fill wire may be approximately 4.81 inches while the distance between respective pairs of warp wires which engage the coil of the spring is approximately 4 inches. Preferably, the ends of each support wire extend approximately 1 inch past the adjacent fill wire. Conveniently, the fill wires may also have a diameter of 0.086 inches. With the above indicated spacings between the fill wires and the warp wires, the grid may readily receive springs having end coils which have a diameter of 4.625 inches. In order to achieve the above indicated spacing between the fill wires and recognizing that the spacing between the fill wires is diminished when the ears are formed, a grid may be supplied to the grid forming process which has a 5.5 inch spacing between the fill wires, i.e. the 5.5 inch spacing between the fill wires will be pulled down to a 4.81 inch spacing when ears are formed.

Although preferred embodiments of my invention have hereinbefore been described, it is expected that those skilled in the art to which this invention pertains may perceive other embodiments of my invention without departing from the scope of my invention as defined by the appended claims.

I claim:

1. The method of manufacturing a box spring support grid which comprises:

a. supplying a wire mesh grid comprised of longitudinal grid wires, longitudinal support wires intermediate selected pairs of said longitudinal grid wires and transverse grid wires;

b. forming an ear in each of said longitudinal support wires and in each of said longitudinal grid wires and between each of said transverse grid wires; and c. removing the center portion of each of said support wires between selected pairs of said transverse grid wires.

2. The process of claim 1 wherein said forming step comprises:

a. forming vertically upstanding ears; and b. deforming said ears on said longitudinal grid wires so that each of said ears on said longitudinal grid wires lies in a plane transverse to a vertical plane through said longitudinal grid wires.

3. The method of claim 1 wherein all the ears on a respective longitudinal support wire are deformed in the same direction.

* * * * *